US009257103B2

(12) United States Patent
Miller

(10) Patent No.: US 9,257,103 B2
(45) Date of Patent: Feb. 9, 2016

(54) GUITAR BACK PLATE

(71) Applicant: Michael Scott Miller, Durham, NC (US)

(72) Inventor: Michael Scott Miller, Durham, NC (US)

( * ) Notice: Subject to any disclaimer, the term of this patent is extended or adjusted under 35 U.S.C. 154(b) by 0 days.

(21) Appl. No.: 14/790,601

(22) Filed: Jul. 2, 2015

(65) Prior Publication Data

US 2015/0302836 A1 Oct. 22, 2015

Related U.S. Application Data

(63) Continuation-in-part of application No. 14/264,911, filed on Apr. 29, 2014, now Pat. No. 9,111,511.

(60) Provisional application No. 62/020,680, filed on Jul. 3, 2015, provisional application No. 61/816,890, filed on Apr. 29, 2013.

(51) Int. Cl.
*G10D 3/14* (2006.01)
*G10D 3/00* (2006.01)

(52) U.S. Cl.
CPC ..... *G10D 3/146* (2013.01)

(58) Field of Classification Search
CPC ..... G10D 3/146
See application file for complete search history.

(56) References Cited

U.S. PATENT DOCUMENTS 2,741,146 A * 4/1956 Fender ..... G10D 3/146 84/313
9,111,511 B2 * 8/2015 Miller ..... G10D 3/02

* cited by examiner

*Primary Examiner* — Robert W Horn

(57) ABSTRACT

A back plate attachable to the back of a guitar is provided. The plate includes screw holes and tremolo plate holes. The screw holes of the plate align with the screw holes on a guitar, and the tremolo plate holes of the plate align with the tremolo claw holes of a tremolo claw. The plate may be bolted or screwed to the back of the guitar via the screw holes and tremolo claw holes.

7 Claims, 3 Drawing Sheets

GUITAR BACK PLATE

CROSS-REFERENCE TO RELATED APPLICATION

This application claims the benefit of priority of U.S. provisional application No. 61/816,890, filed Apr. 29, 2013 and U.S. provisional application No. 62/020,680, filed Jul. 3, 2014, and is a continuation-in-part of U.S. non-provisional application Ser. No. 14/264,911, filed Apr. 29, 2014, the contents of which are herein incorporated by reference.

BACKGROUND OF THE INVENTION

The present invention relates to a guitar back plate and, more particularly, to a guitar back plate for improving the resonance of the guitar.

A guitar is a popular musical instrument that makes sound by the playing of its (typically) six strings with the sound being projected either acoustically or through electrical amplification. Currently, a large amount of electric guitars lack resonance as a result of being made from inferior materials. All of the separate elements of the guitar function independently, which dampens the natural resonance of the electric guitar.

As can be seen, there is a need for a device that improves the resonance of the guitar.

SUMMARY OF THE INVENTION

In one aspect of the present invention, a guitar back attachment comprises: a plate comprising a top surface, a bottom surface, a top end and a flange formed at a bottom end, wherein a plurality of plate screw holes are formed at the top end of the plate and positioned to align with a plurality of guitar screw holes used to join a neck of a guitar to a body of the guitar, a plurality of tremolo plate holes are formed through the flange and positioned to align with a plurality of tremolo claw holes of a tremolo claw.

In another aspect of the present invention, a guitar comprises: a body portion comprising a front surface and a back surface, and comprising a tremolo cavity and a plurality of guitar screw holes formed on the back surface; a tremolo claw disposed within the tremolo cavity and comprising a plurality of tremolo claw holes; a neck portion extending from the body portion; and a plate comprising a top end and a bottom end, wherein the top end comprises a plurality of plate screw holes formed to align with the plurality of guitar screw holes and the bottom end comprises a plurality of tremolo plate holes formed to align with the plurality of tremolo claw holes, wherein the plate is attached to the back surface of the body portion.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a back plate attachable to the back of a guitar. The plate includes screw holes and tremolo plate holes. The screw holes of the plate align with the screw holes on a guitar, and the tremolo plate holes of the plate align with the tremolo claw holes of a tremolo claw. The plate may be bolted or screwed to the back of the guitar via the screw holes and tremolo claw holes.

The present invention includes a metal plate that bolts to the back of an electric guitar, bridging the neck mount to the tremolo cavity. The present invention includes neck mounting holes and may replace the neck mounting plate currently attached to the guitar. The plate further includes tremolo plate holes at the opposite end of the neck mounting holes. The plate may lie in contact with the back of the electric guitar and bridge the gap between the neck mount and the tremolo cavity. Therefore, the neck mount, the tremolo claw and the body may function as one vibrating entity, thereby drastically increasing the resonance.

Figure 1:
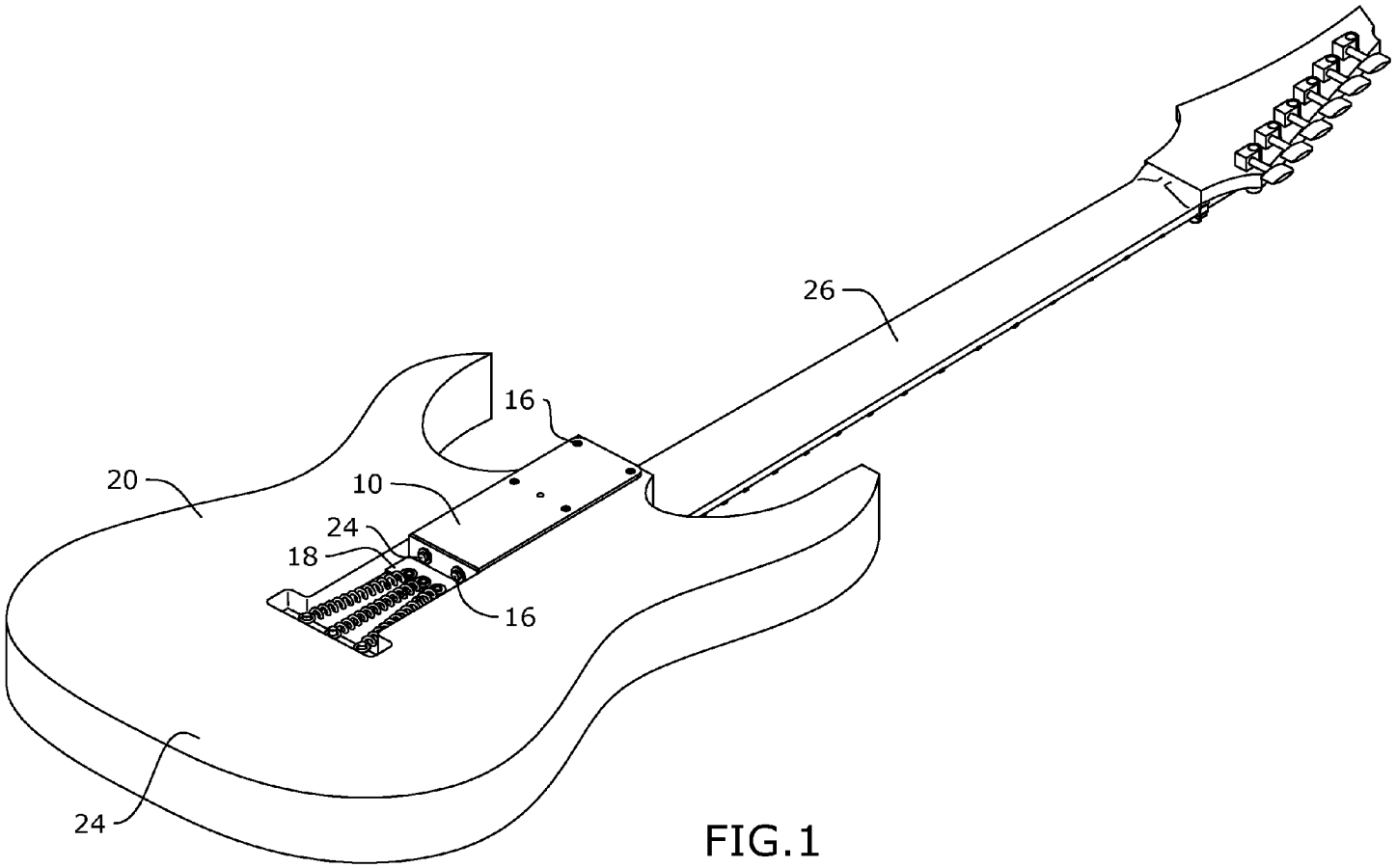
FIG. 1 is a perspective view of an embodiment of the present invention shown in use.
Figure 2:
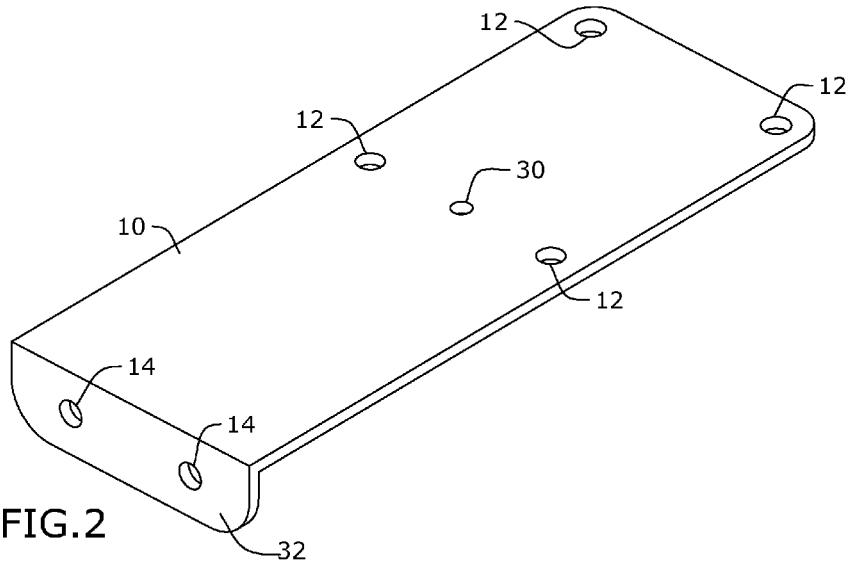
FIG. 2 is a perspective view of an embodiment of the present invention.
Figure 3:
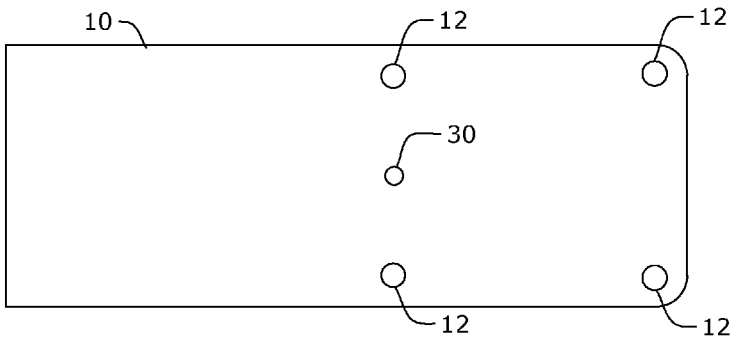
FIG. 3 is a top view of an embodiment of the present invention.
Figure 4:
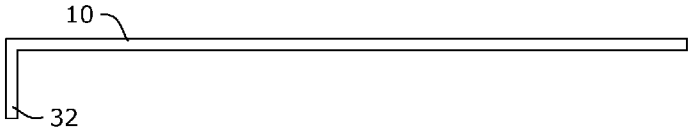
FIG. 4 is a side view of an embodiment of the present invention.
Figure 5:
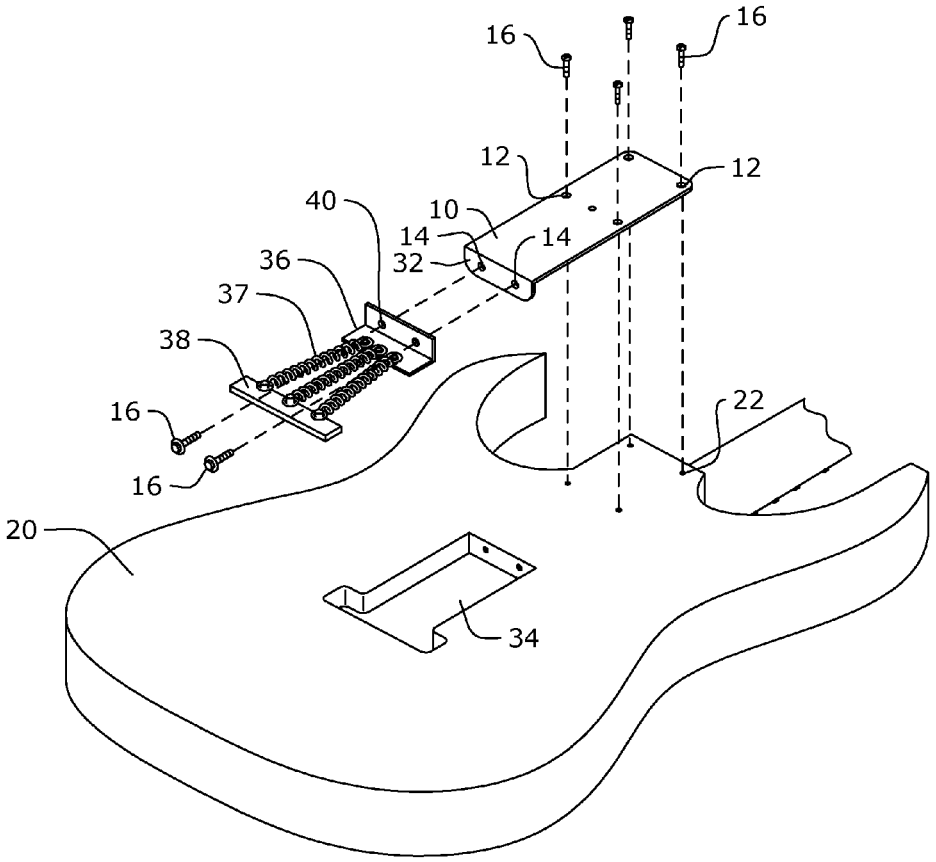
FIG. 5 is a perspective view of an embodiment of the present invention shown in use.

Referring to FIGS. 1 through 5, the present invention includes a guitar back attachment plate 10. The plate 10 includes a top surface and a bottom surface. The top and bottom surface may be substantially flat. A plurality of plate screw holes 12 and a plurality of tremolo plate holes 14 may run through the top surface and bottom surface of the plate 10. The tremolo plate holes 14 may be threaded. The plate 10 includes a top end opposite a bottom end. The bottom end may include a bend forming a flange 32. The bend may be about 90 degrees. The plate screw holes 12 may be near a top end of the plate 10, while the tremolo plate holes 14 may be formed through the flange 32 of the plate 10.

The plate 10 is attached to a guitar 20. The guitar 20 includes a neck portion 26 and a body portion 24 having a front surface and a back surface. The neck portion 26 is attached to the body portion 24 by a plurality of screws 16 that run through a plurality of guitar screw holes 22 in the body portion 24 and into the neck portion 26. The body portion 24 of the guitar 20 may further include a tremolo cavity 34 housing a tremolo claw 36, a spring assembly 37 and a tremolo plate 38. The tremolo claw 36 may be secured within the tremolo cavity 34 via screws 16 running through aligned claw holes 40 and secured into the tremolo plate holes 14 of the plate 10.

The plate 10 is attached to the back surface of the body portion 24 of the guitar 20. The plurality of plate screw holes 12 align with the plurality of guitar screw holes 22. Screws 16 or bolts may be driven through the aligned screw holes 12, 22 and into the neck portion 26 of the guitar 20. The plurality of tremolo plate holes 14 align with the plurality of tremolo claw holes 40. Screws 16 or bolts may be driven through the aligned tremolo claw holes 40, and secured to tremolo plate holes 14, thereby securing the plate 10 to the tremolo claw 36, and the tremolo spring assembly 37.

In certain embodiments, the guitar 20 may include a micro tilt adjustment. In such embodiments, an allen screw is used to adjust the tilt of the neck portion 26. The plate 10 of the present invention may include a micro tilt adjustment opening 30. The micro tilt adjustment opening 30 may align with the micro tilt adjustment screw of the guitar 20. Therefore, a user may adjust the tilt of the neck portion 26 with the plate 10 of the present invention attached to the back surface of the body portion of the guitar 20.

The plate 10 of the present invention may be made of a resonant material, such as metal. For example, the plate may be made of aluminum. The present invention may be made from a single piece sized to include the neck mounting holes 12 on one end and the tremolo plate holes 14 on the other. By combining both functions into one piece it increases the resonance of the guitar 20.

It should be understood, of course, that the foregoing relates to exemplary embodiments of the invention and that modifications may be made without departing from the spirit and scope of the invention as set forth in the following claims.

What is claimed is:

1. A guitar back attachment comprising:

a plate comprising a top surface, a bottom surface, a top end and a flange formed at a bottom end, wherein a plurality of plate screw holes are formed at the top end of the plate and positioned to align with a plurality of guitar screw holes used to join a neck of a guitar to a body of the guitar, a plurality of tremolo plate holes are formed through the flange and positioned to align with a plurality of tremolo claw holes of a tremolo claw.

2. The guitar back attachment of claim 1, wherein the bottom surface is substantially flat and formed to rest against a back surface of the body of the guitar.

3. The guitar back of attachment claim 1, wherein the plate further comprises a plate micro tilt adjustment hole positioned to align with a micro tilt adjustment on the back of the guitar.

4. A guitar comprising:

a body portion comprising a front surface and a back surface, and comprising a tremolo cavity and a plurality of guitar screw holes formed on the back surface;

a tremolo claw disposed within the tremolo cavity and comprising a plurality of tremolo claw holes;

a neck portion extending from the body portion; and a plate comprising a top end and a bottom end, wherein the top end comprises a plurality of plate screw holes formed to align with the plurality of guitar screw holes and the bottom end comprises a plurality of tremolo plate holes formed to align with the plurality of tremolo claw holes, wherein the plate is attached to the back surface of the body portion.

5. The guitar of claim 4, further comprising a plurality of screws through the plurality of plate screw holes and plurality of guitar screw holes, thereby attaching the plate to the body portion.

6. The guitar of claim 4, further comprising a flange formed at the bottom end of the plate, wherein the plurality of tremolo plate holes are formed through the flange.

7. The guitar of claim 4, wherein the plate further comprises a plate micro tilt adjustment hole aligning with a micro tilt adjustment on the back surface of the body portion.

* * * * *